US009367040B2

(12) United States Patent
Reynard

(10) Patent No.: US 9,367,040 B2
(45) Date of Patent: Jun. 14, 2016

(54) TIMEPIECE INTENDED TO INDICATE THE POWER RESERVE

(71) Applicant: Beranger Reynard, Grande Combe Chateleu (FR)

(72) Inventor: Beranger Reynard, Grande Combe Chateleu (FR)

(73) Assignee: Parmigiani Fleurier SA (CH)

( * ) Notice: Subject to any disclaimer, the term of this patent is extended or adjusted under 35 U.S.C. 154(b) by 0 days.

(21) Appl. No.: 14/439,232

(22) PCT Filed: Jul. 31, 2013

(86) PCT No.: PCT/IB2013/001674
§ 371 (c)(1),
(2) Date: Apr. 29, 2015

(87) PCT Pub. No.: WO2014/068375
PCT Pub. Date: May 8, 2014

(65) Prior Publication Data

US 2015/0293500 A1 Oct. 15, 2015

(30) Foreign Application Priority Data

Oct. 30, 2012 (CH) ..... 2176/12

(51) Int. Cl.
*G04B 9/00* (2006.01)
*G04B 19/21* (2006.01)

(52) U.S. Cl.
CPC ..... *G04B 19/21* (2013.01); *G04B 9/005* (2013.01)

(58) Field of Classification Search
CPC ..... G04B 19/21; G04B 9/00; G04B 9/005
USPC ..... 368/66
See application file for complete search history.

(56) References Cited

U.S. PATENT DOCUMENTS

| | | | | |
|---|---|---|---|---|
| 6,166,999 | A * | 12/2000 | Jujo | G04B 9/005 368/203 |
| 7,021,819 | B2 * | 4/2006 | Schmiedchen | G04B 23/02 368/147 |
| 7,490,977 | B2 * | 2/2009 | Zaugg | G04B 9/00 368/210 |
| 7,508,738 | B2 * | 3/2009 | Meier | G04B 1/12 368/101 |
| 7,614,784 | B2 * | 11/2009 | Watanabe | G04B 9/005 368/210 |
| 8,356,930 | B2 * | 1/2013 | Capt | G04B 9/005 368/147 |
| 2008/0225646 | A1 * | 9/2008 | Zaugg | G04B 9/00 368/66 |

FOREIGN PATENT DOCUMENTS

| | | | |
|---|---|---|---|
| CH | 263707 | A | 9/1949 |
| EP | 1970778 | A1 | 9/2008 |
| NL | 4605 | C | 11/1916 |

* cited by examiner

*Primary Examiner* — Sean Kayes
(74) *Attorney, Agent, or Firm* — Galbreath Law Offices, P.C.; John A. Galbreath

(57) ABSTRACT

A horological instrument intended to indicate the power reserve, includes a barrel (1) provided with a drum (2) arranged to turn in one direction during operation of the horological instrument, the drum (2) including around the periphery thereof at least one power reserve scale (4). At least one hand (13) is arranged to turn with the drum (2) and cooperates with a corresponding power reserve scale (4). Furthermore, a mechanism for displacing the hand or hands (13) is arranged to displace the hand or hands by one step with respect to the corresponding scale of the drum (2) with each revolution or with each fraction of revolution of the drum (2) and the hand (13) in order to progressively indicate the power reserve.

8 Claims, 3 Drawing Sheets

TIMEPIECE INTENDED TO INDICATE THE POWER RESERVE

The present invention relates to a horological instrument comprising a movement provided with a device for indicating the power reserve.

Horological instruments capable of indicating the power reserve are already known from the state of the art. By way of example, EP1970778 discloses a horological instrument comprising a device for indicating the power reserve carried by a crown with internal teeth forming the outlet of the differential geartrain.

Also known is patent CH 263 707 which describes a differential geartrain for displaying the power reserve of a watch. This differential geartrain includes two large wheels provided, on the one hand, with radial teeth kinematically connected to one end and the other end of the barrel spring and, on the other hand, with edged teeth arranged to be meshed with a satellite having the shape of a conventional pinion.

Horological instruments comprising devices for providing this power reserve indication are designed to take into account the rotation of the ratchet wheel during the winding of the barrel spring as well as the rotation of the barrel during the unwinding of the barrel spring. In order to do this, most of these known devices implement a differential geartrain. A device of this type is described, for example, in patent EP 1 074 897 in which the two inlets of the differential geartrain are respectively connected to the teeth of the barrel drum and to that of the ratchet wheel, the outlet of the differential geartrain being connected to an indicating member.

Also known from utility model DE1638800U is a device for indicating the power reserve using a flat differential geartrain with dual satellite disposed between the barrel bridge and the barrel cover aiming to eliminate the reduction gears for winding and unwinding. However, the reduction ratio offered by this type of differential geartrain does not allow displaying the power reserve on an arc of a circle that extends only for example of the order of 30°, without gears for reducing the display.

The aim of the present invention is to propose a horological instrument intended to indicate the power reserve visibly and simply on the drum of the barrel thereof.

According to the invention, a horological instrument for indicating the power reserve includes a barrel provided with a drum arranged to turn in one direction during operation of the horological instrument. The drum includes around the periphery thereof at least one power reserve scale. At least one hand is arranged to turn with the drum and which cooperates with a corresponding scale of the power reserve. Finally, a mechanism for displacing the hand or hands is arranged to displace the hand or hands by one step with respect to the corresponding scale of the drum with each revolution or with each fraction of revolution of the drum and the hand in order to progressively indicate the power reserve.

The scale or scales indicate(s) for example an increasing power reserve in the direction of rotation of the drum. In this case, the mechanism for displacing the hand or hands is arranged to displace the hand or hands by one step at each revolution or fraction of revolution of the drum in the direction opposite to the rotation direction of the drum.

In an implementing embodiment, the barrel drives a part including one finger or several fingers distributed around the periphery thereof, this finger or these fingers drive with each revolution or each fraction of revolution a satellite wheel carried by the cover of the drum. This satellite wheel is connected to a rotatable member carrying the hand or hands in order to displace this rotatable member by one step at each revolution or each fraction of revolution. In particular, the satellite wheel is maintained by a pawl which allows it to advance by one step at each revolution or fraction of revolution.

The principle of operation is inspired from the Maltese cross stopwork system. The Maltese cross may sometimes have a few defects such as an overly weak geartrain despite a finger and a cross of good size and good shape, an overly small finger and its too short tooth, and many other defects which one should provide against by replacing the cam system by a wheel. A part composed of two diametrically opposite fingers, fixed on the barrel arbor and a stop-wheel or wheel called satellite wheel fixed onto the barrel cover limit the degree of winding of the barrel.

The horological instrument also preferably includes, a hand system called "spider hands" which will make the power reserve readable. In particular, another implementation includes on the one hand four scales distributed in an equidistant manner on the barrel drum, and includes on the other hand a spider hand system provided with four hands maintained by four perpendicular arms secured to a wheel called the display wheel, the four hands each indicating the remaining power reserve on any of the four scales.

The features of the invention will become more apparent upon reading the description of a preferential implementing embodiment, given only by way of non limiting example, with reference to the schematic figures in which.

Figure 1:
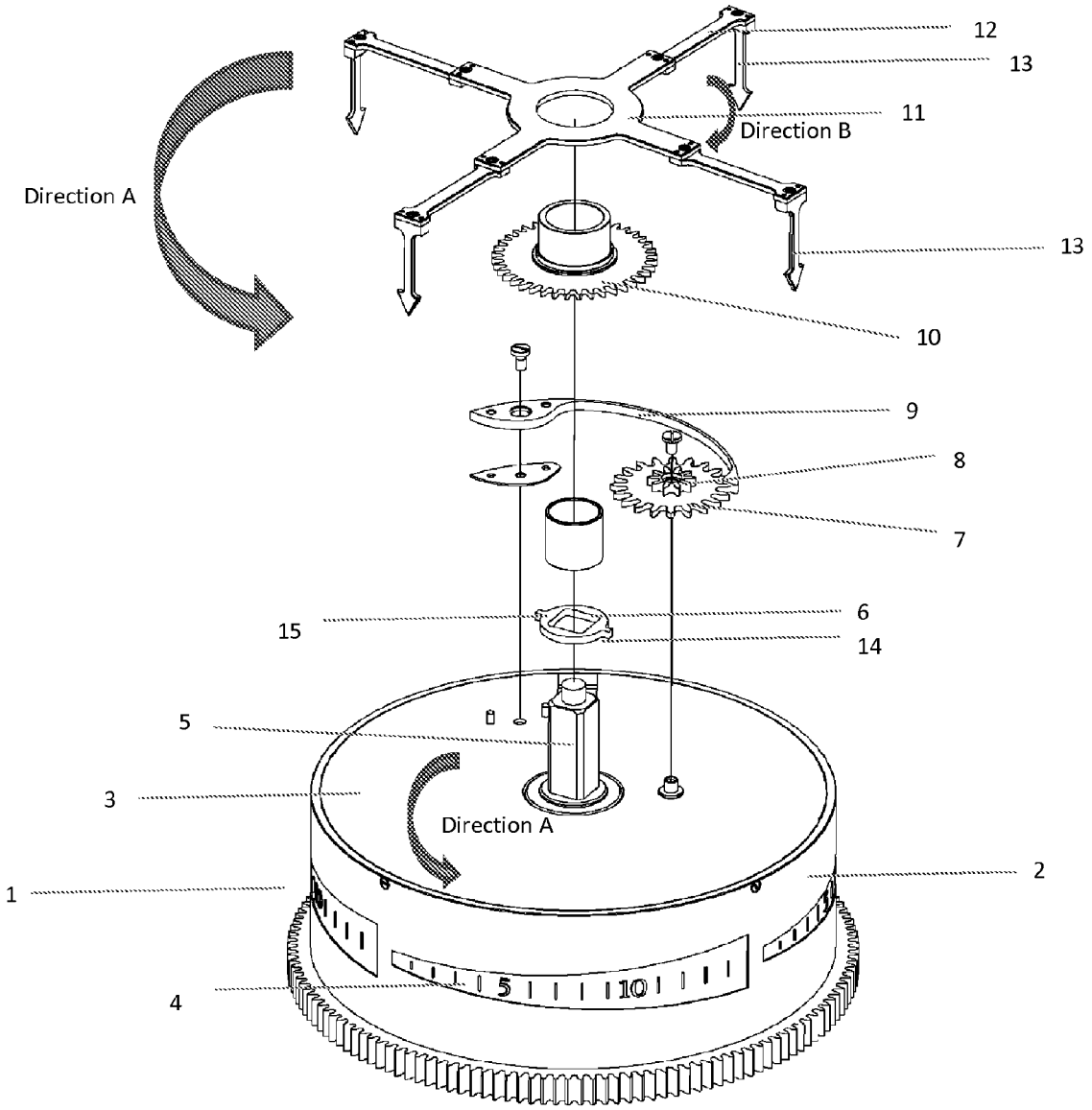
FIG. 1 represents an exploded view of the mechanism indicating the power reserve.
Figure 2:
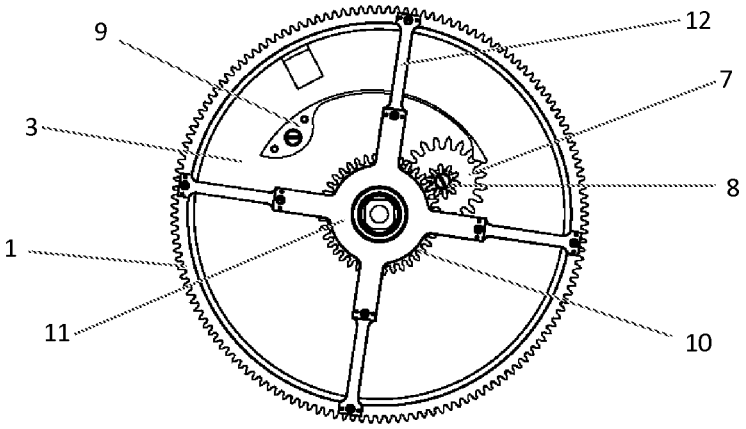
FIG. 2 represents an elevational view of the mechanism indicating the power reserve.
Figure 3:
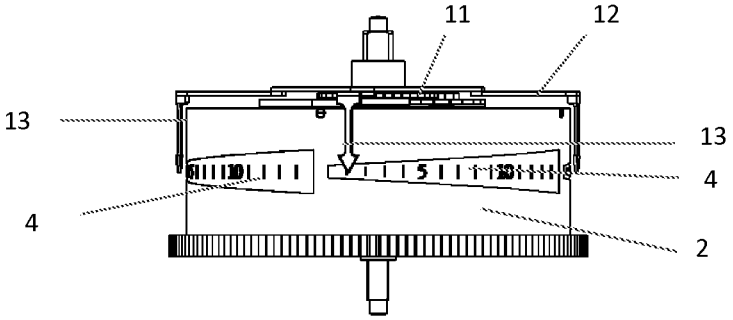
FIG. 3 represents a side view of the mechanism indicating the power reserve.

According to the preferential embodiment of the invention, the horological instrument is a table clock which comprises a barrel 1 displaying on the drum 2 thereof a power reserve scale 4, a barrel axle square 5 on which is positioned a part 6 composed of two fingers 14, 15 secured to and diametrically opposite a satellite wheel 7, maintained by a pawl 9 itself fixed to the barrel cover 3. A pinion 8 secured to the satellite wheel 7 and fixed to the barrel cover 3, meshed with hand displaying wheel 10 on which a spider hand system 16 is positioned composed of a wheel 11 provided with four arms 12 at the end of which a display hand 13 is maintained, thus providing an indication of the power reserve.

The scale 4 for displaying the power reserve is repeated four times on the barrel 1 in such a manner that the power reserve may be read permanently when the barrel 1 revolves. This scale 4 is graduated in such a manner as to represent fifteen units, representing the fifteen days of power reserve. The four scales 4 are distributed in an equidistant manner on the drum 2 of the barrel 1.

By winding the clock, the satellite wheel 7 is made to revolve by means of the two fingers 14, 15. This satellite wheel 7, secured to the cover 3, drives the display wheel 10 by the coaxial pinion 8. When the movement is operating, the barrel axle 5 being at rest, the barrel 1 itself is in movement in the direction A, this wheel 7 will revolve like a satellite around the barrel axle 5. During rotation of the barrel 1, the spider hand system 16 also rotates in the direction A, in accordance with the indications of FIG. 1, thus, the barrel 1 and the spider hand system 16 revolve in the same direction. The wheel 7 passes every five and a half hours in front of the stationary fingers 14, 15 of the barrel axle. With each half-revolution a finger 14, 15 drives a tooth of the satellite wheel 7, thus making the spider hand system 16 jump by one step in the opposite direction (direction B FIG. 1) to the barrel 1 in order to make the power reserve readable on the rim of the drum 2 on the four display scales 4, even while the barrel 1 revolves permanently.

Each of the hands 13 maintained by the arms 12 indicates the power reserve on any of the display scales 4.

Figure 4:
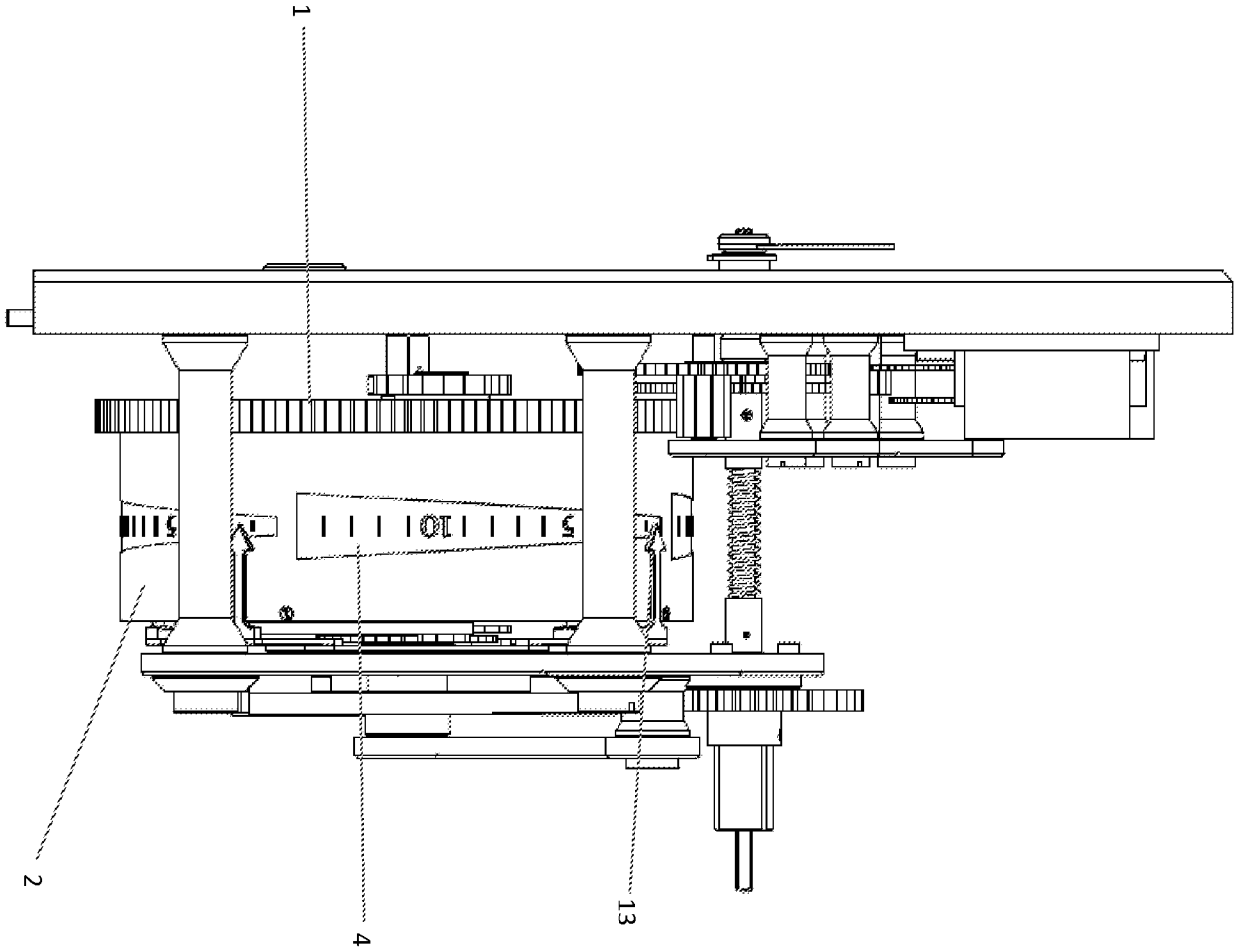
FIG. 4 represents a side view of a horological instrument provided with such a mechanism indicating the power reserve.

As can be seen on FIG. 4, the barrel is housed in a rear portion of the table clock, the rear and lateral portions of the table clock must be open or transparent or accessible by a door in such a manner as to make the drum 2 and the scale or scales 4 visible.

The invention claimed is:

1. A horological instrument for indicating power reserve, including:

a barrel (1) provided with a drum (2) arranged to turn in one direction during operation of the horological instrument, the drum (2) including on its periphery at least one power reserve scale (4) which extends around the periphery of the drum (2), at least one hand (13) arranged to turn with the drum (2) and which cooperates with a corresponding power reserve scale (4) located on the periphery of the drum (2), and a mechanism for displacing the hand or hands (13) arranged to displace the hand or hands by one step with respect to the corresponding scale of the drum (2) with each revolution or with each fraction of revolution of the drum (2) and the hand (13) in order to progressively indicate the power reserve on the periphery of the drum (2), wherein the barrel (1) drives a part (6) including one finger or several fingers (14, 15) distributed around the periphery thereof, this finger or these fingers (14, 15) drive with each revolution or each fraction of revolution a satellite wheel (7) carried by the cover (3) of the drum (2), said satellite wheel (7) being connected to a rotatable member carrying said at least one hand (13) in order to displace this rotatable member by one step for each revolution or each fraction of revolution, and wherein the part (6) includes two diametrically opposite fingers.

2. The horological instrument according to claim 1, wherein the scale or scales (4) indicate(s) an increasing power reserve in the direction of rotation of the drum (2), and the mechanism for displacing the hand or hands is arranged to displace the hand or hands by one step at each revolution or fraction of revolution of the drum (2) in the direction opposite to the rotation direction of the drum (2).

3. The horological instrument according to claim 1, wherein the satellite wheel is maintained by a pawl (9) allowing it to advance by one step for each revolution or fraction of revolution.

4. The horological instrument according to claim 1, including on the one hand four scales (4) distributed in an equidistant manner on the drum (2) of the barrel (1), and including on the other hand a spider hand system (16) provided with four hands (13) maintained by four perpendicular arms (12) and secured to a wheel (11) called display wheel, the four hands (13) each indicating the remaining power reserve on any of the four scales (4).

5. The horological instrument according to claim 1, wherein the power reserve is indicated on the scale or each scale (4) by a graduation in days.

6. The horological instrument according to claim 5, wherein the scale or each scale (4) indicates a power reserve that can go up to 15 days.

7. The horological instrument according to claim 1, wherein said horological instrument is a clock.

8. The horological instrument according to claim 7, wherein the barrel (1) is housed in a rear portion of the clock, the rear and lateral portions of the clock being open or transparent or accessible by a door in such a manner as to make the drum (2) and the scale or scales (4) visible.

* * * * *